US007222605B2

(12) United States Patent
Kusatsugu et al.

(10) Patent No.: US 7,222,605 B2
(45) Date of Patent: May 29, 2007

(54) THROTTLE CONTROL SYSTEM AND METHOD

(75) Inventors: Hideyuki Kusatsugu, Kariya (JP); Shinji Yogo, Okazaki (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 11/283,782

(22) Filed: Nov. 22, 2005

(65) Prior Publication Data

US 2006/0107923 A1 May 25, 2006

(30) Foreign Application Priority Data

Nov. 25, 2004 (JP) ..... 2004-340705

(51) Int. Cl.
*F02D 11/10* (2006.01)

(52) U.S. Cl. ..... 123/399

(58) Field of Classification Search ..... 123/361, 123/396, 397, 399
See application file for complete search history.

(56) References Cited

U.S. PATENT DOCUMENTS 4,455,978 A * 6/1984 Atago et al. ..... 123/361
4,581,924 A * 4/1986 Otobe et al. ..... 123/399
5,161,505 A * 11/1992 Bederna et al. ..... 123/399
5,170,860 A * 12/1992 Suzuki et al. ..... 123/399
5,606,950 A * 3/1997 Fujiwara et al. ..... 123/399
5,950,597 A 9/1999 Kamio et al. ..... 123/397
6,352,064 B1 * 3/2002 Tomita et al. ..... 123/396
6,588,400 B2 * 7/2003 Gyoergy et al. ..... 123/399
6,619,259 B2 * 9/2003 Tomita et al. ..... 123/396

FOREIGN PATENT DOCUMENTS

JP 2003-214221 7/2003
JP 2003-214222 7/2003

* cited by examiner

*Primary Examiner*—T. M. Argenbright
(74) *Attorney, Agent, or Firm*—Nixon & Vanderhye P.C.

(57) ABSTRACT

A throttle control system includes a valve, an electric throttle unit, a control unit, a throttle sensor, a memory device, and a memory execution unit. The throttle control system operates the memory execution unit to allow the memory device to store an opening signal detected by the throttle sensor as a "detected full opening" of the valve, when energization of the electric throttle unit is stopped by the control unit and the valve stops at a "mechanical full opening" by mechanical operation. Thus, it becomes possible to coincide the actual valve opening of the valve and a "control valve opening" which the control unit recognizes. Therefore, it becomes possible to decrease system variation between the electric throttle unit and the control unit. Moreover, a control accuracy of an air intake amount by the throttle control system can be improved.

9 Claims, 4 Drawing Sheets

THROTTLE CONTROL SYSTEM AND METHOD

CROSS REFERENCE TO RELATED APPLICATION

This application is based on and incorporates herein by reference Japanese Patent Application No. 2004-340705 filed on Nov. 25, 2004.

TECHNOLOGICAL FIELD

Example embodiments of the technology described herein relate to a throttle control system and method for controlling an electric throttle unit of the type which a valve stops by the mechanical operation of a spring etc. at a "mechanical full opening" (a mechanical rotatable maximum valve opening) when energization of the electric throttle unit is stopped by an ECU (engine control unit).

DESCRIPTION OF RELATED ART

It is known that an electric throttle unit drives a valve to open and close an air intake passage by an electric actuator (for example, an electric motor combined with an electric motor or gears). This kind of electric throttle unit is disclosed in JP-A-2004-301133.

This electric throttle unit is electrically controlled by an engine control unit (ECU), and this ECU controls energization of the electric throttle unit (specifically, an electric actuator) according to an operational condition, such as accelerator pedal position which a driver operates, and adjusts the valve opening.

In a full open stop type electric throttle, a throttle valve stops at a full opening position (mechanical full opening) by mechanical operation when energization of the electric throttle unit is stopped. The throttle valve stops at the full opening position so that the valve may be prevented from adhering in a state where it is stuck by a throttle bore. That is, when energization of the electric throttle unit is stopped by the ECU, the valve runs against the surface of a wall of the throttle bore.

An operation control for an energization stopping condition of such a full open stop type electric throttle is explained with reference to an operation diagram of FIG. 2 and a time chart of FIG. 5. In addition, a solid line in FIG. 5 (at the bottom of FIG. 5) shows a target valve opening of the valve which the ECU computes, and a dashed line in FIG. 5 (at the bottom of FIG. 5) shows an actual valve opening of the valve.

If an engine is stopped by turning off an ignition switch (see ↓ in the line labeled "IG" in FIG. 5), (1) the ECU holds the valve near a full closed position (i.e. valve opening is full closed) once in order to reduce vibration of the engine produced when the engine is stopped. Next, (2) when the stop of the engine is detected (for example, when engine rotational speed becomes zero), the ECU makes the valve rotate to a predetermined opening A (an "energization stopping opening A") from the full closed position in the direction that opens the valve and maintains the valve at the "energization stopping opening A". This "energization stopping opening A" is also labeled in FIG. 2. After that, (3) the ECU stops energization of the electric throttle unit (see ↓ in the line labeled "energization condition" in FIG. 5 indicating "Stop of energization"). (4) When energization of the electric throttle unit is stopped, the valve further rotates from the "energization stopping opening A" by mechanical operation in the direction (counter-clockwise in FIG. 2) that opens the valve and stops at a "mechanical full opening B". (This "mechanical full opening B" is also labeled in FIG. 2.)

Here, there is a mechanical variation in the electric throttle unit. For this reason, in the throttle control system of this related art, a system variation may arise between a "control valve opening" (a valve opening which the ECU computed and recognizes) and an "actual valve opening" of the valve.

Furthermore, in a throttle control system, the "energization stopping opening A" is set up more on the closed valve side than the "mechanical full opening B", taking into consideration the system variation. Specifically, the "energization stopping opening A" is set up as a "control full opening A" at the time when a control valve opening is an opening having a 100% aperture ratio of the air intake passage in the throttle control system. Thus, there is a large rotational difference in the valve opening positions between the "energization stopping opening A" and the "mechanical full opening B". This large rotational difference is labeled as "γ" in FIG. 2 and FIG. 5.

Because of the large rotational difference (γ) in the valve opening positions between the "energization stopping opening A" and the "mechanical full opening B", a problem results. This problem is that a collision sound made at the time a part of a moving portion of the electric throttle unit abuts on a full open stopper provided with a fixed portion becomes larger when energization of the electric throttle unit is stopped.

SUMMARY OF EXAMPLE EMBODIMENTS OF THE INVENTION

Example embodiments of present invention resolve the foregoing matter and other problems. One aspect of example embodiments of the present invention is to provide a throttle control system that can decrease a system variation between a "control valve opening" (operation valve opening) of the ECU and an "actual valve opening" of a valve.

Another aspect of example embodiments of the present invention is to provide a throttle control system that can reduce the collision sound at the time the energization of an electric throttle unit is stopped.

According to one aspect of the present invention, a throttle control system includes a valve, an electric throttle unit, a control unit, a throttle sensor, a memory device, and a memory execution unit. The throttle control system operates the memory execution unit to enable the memory device to store an opening signal detected by the throttle sensor as a "detected full opening" of the valve, when energization of the electric throttle unit is stopped by the control unit and the valve stops at a "mechanical full opening" by mechanical operation. Thus, it becomes possible to coincide the actual valve opening of the valve and a "control valve opening" which the control unit recognizes. Therefore, it becomes possible to decrease system variation between the electric throttle unit and the control unit. Moreover, a control accuracy of an air intake amount by the throttle control system can be improved.

According to another aspect of the present invention, the throttle control system makes the memory execution unit to operate the memory device to store an opening signal detected by the throttle sensor as a "detected full opening" of the valve, before beginning energization of the electric throttle unit. Accuracy in compensating for a variation in the electric throttle unit can always be kept high, since the "detected full opening" is detected whenever the engine starts.

According to another aspect of the present invention, the valve stops at the "mechanical full opening" by abutting a moving portion of the electric throttle unit on a full open stopper provided with a fixed portion, when energization of the electric throttle unit is stopped.

According to another aspect of the present invention, the throttle control system includes an energization stopping control unit, and the energization stopping control unit stops energization of the electric throttle unit at an "energization stopping opening" which sets a predetermined angle to the closed valve opening side from the "detected full opening" memorized by the memory device. Thus, even if a mechanical variation has been produced in the electric throttle unit, a rotational difference in the valve opening positions between the "actual valve opening " of the valve at the time of the "energization stopping opening" and the "mechanical full opening" after stopping energization of the electric throttle unit is always made to a regular consistent amount, that is, the predetermined angle.

BRIEF DESCRIPTION OF THE DRAWINGS

The present invention will be understood more fully from the detailed description given hereinafter and from the accompanying drawings of the example embodiments of the invention, which, however, should not be taken to limit the invention to the specific embodiments but are for the purpose of explanation and understanding only.

In the accompanying drawings.

DETAILED DESCRIPTION OF EXAMPLE EMBODIMENTS

An embodiment of the present invention of a throttle control system is explained with reference to FIGS. 1–4.

Figure 4:
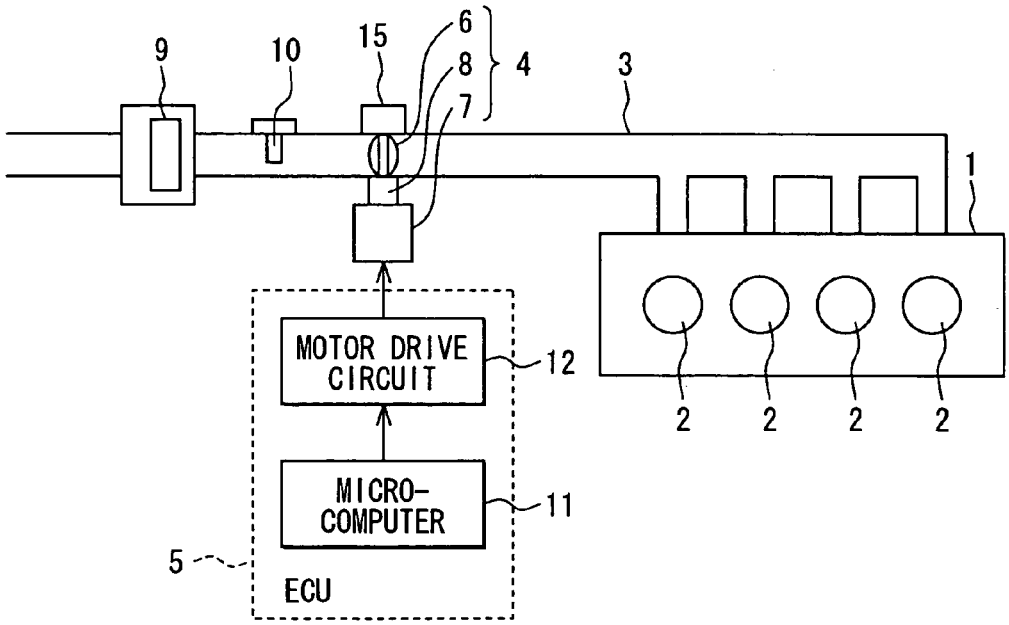
FIG. 4 is an outline composition figure of the throttle control system.

Example embodiments of the throttle control system are now explained with reference to FIG. 4. The throttle control system includes an electric throttle unit 4 which adjusts a valve opening of an air intake passage 3 leading intake air to each cylinder 2 of an engine 1, and an ECU (electric control unit) 5 which carries out drive control of this electric throttle unit 4.

The electric throttle unit 4 is arranged inside the air intake passage 3. The electric throttle unit 4 includes a valve 6 (throttle valve) which is continuously rotatable between a fully closed opening position and a fully opened opening position in the air intake passage 3, an electric actuator 7 which can rotate a shaft of the valve 6, and a throttle sensor 8 which detects the rotation angle of the shaft, i.e., the valve opening of the valve 6. This electric throttle unit 4 stops the valve 6 at a "mechanical full opening B" (refer to FIG. 2) by mechanical operation when energization of the electric throttle unit 4 (specifically electric actuator 7) is stopped. The "mechanical full opening B" is set up as a valve opening at the time which the valve 6 is rotated a predetermined angle ("γ" illustrated in FIG. 2) exceeding an valve opening of 100% aperture ratio of the air intake passage 3 in the direction (counter-clockwise in FIG. 2) that opens the valve 6.

Figure 1:
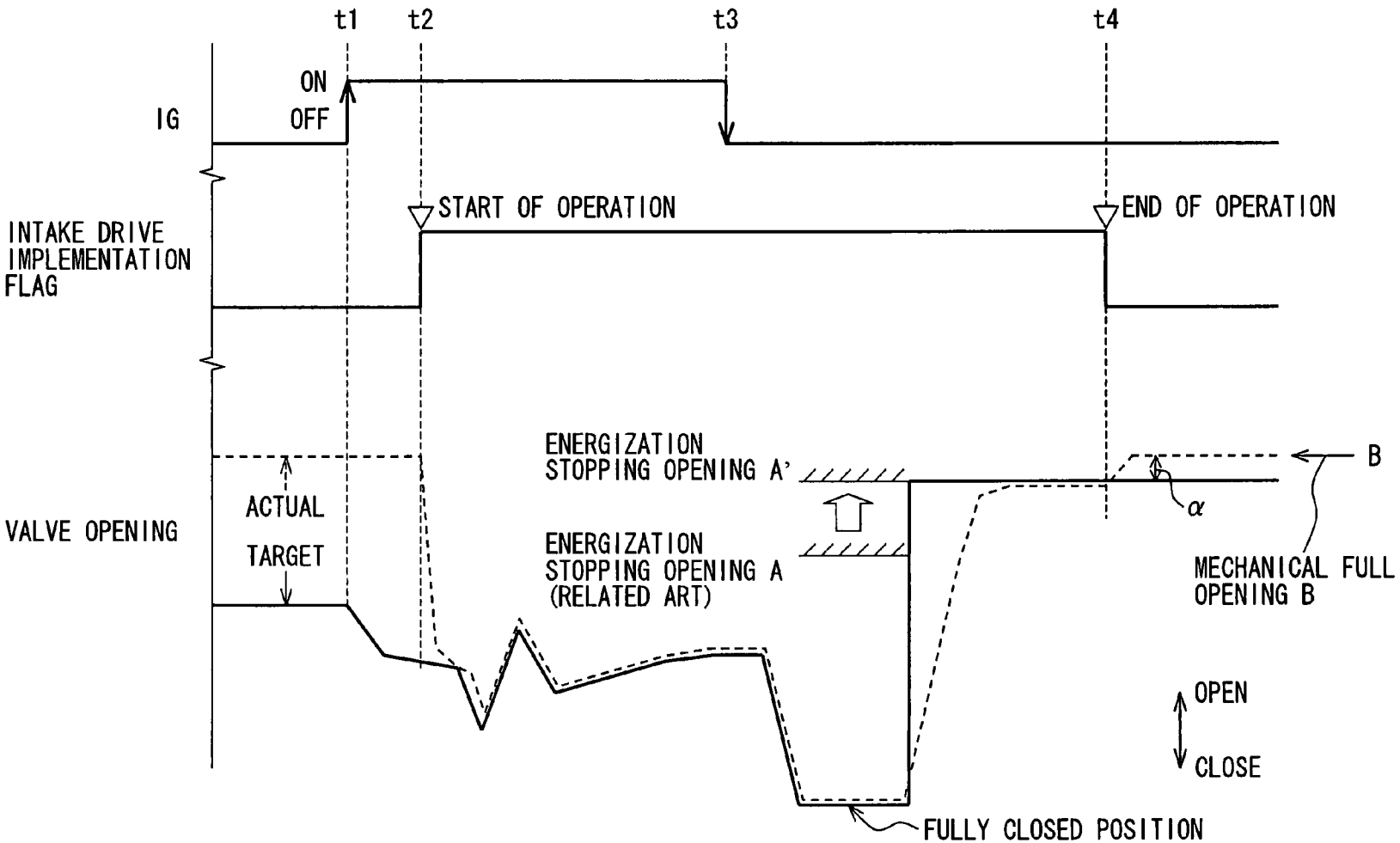
FIG. 1 is a time chart showing an operation of a throttle control system according to an example embodiment of the invention.

Specifically, when energization of the electric throttle unit 4 is stopped (at the timing t4 (End of operation) in FIG. 1), the actuator 7 further rotates the valve 6 in the direction (counter-clockwise direction in FIG. 2) that opens the valve 6 and stops at the "mechanical full opening B". The valve 6 stops at the "mechanical full opening B" because a part of a moving portion of the electric throttle unit 4 which moves in cooperation with the valve 6 abuts against a full open stopper 15 provided with a fixed portion of the throttle unit 4 by an operation of a spring (not shown) which returns the valve 6 to an initial position.

The electric actuator 7, for example, may be a type which drives the shaft of the valve 6 directly with an output axis of an electric motor which generates torque under energization, or may be a type which drives the shaft of the valve 6 with a reduction mechanism such as gears.

Moreover, the electric actuator 7 may be a stepping motor which can control the rotational angle of the shaft of the valve 6 by choosing a magnetization coil. Also, the electric actuator 7 may be a torque generating motor (for example, a DC motor) which can control the rotation angle of the shaft of the valve 6 by the balance of a force of the spring for moving the valve in the open direction (counter-clockwise direction in FIG. 2) and a torque according to the electric power value (a voltage value and/or a current value) supplied to the torque generating motor for moving the valve in the closed direction.

The throttle sensor 8 may be the potentiometer of a resistance variable type, and may be a magnetic type angle sensor which is combined a permanent magnet and a magnetic sensor (for example, a hole IC).

In addition, the throttle control system provides an air filter 9 which filters intake air, and an air flow meter 10 which detects an amount of intake air.

The ECU 5 carries out energization control of the electric throttle unit 4 (specifically electric actuator 7). The ECU 5 includes a microcomputer 11 and a motor drive circuit 12. The microcomputer 11 includes a CPU for performing control processing and operation processing, a memory device for saving various programs and data (such as standby RAM, or EEPROM, RAM), an input circuit, an output circuit, and a power supply. The motor drive circuit 12 drives the electric actuator 7 according to an output (operation result) of the microcomputer 11. In addition, although FIG. 4 shows an example in which the motor drive circuit 12 is arranged in a case of the ECU 5 in accordance with the first example embodiment, the motor drive circuit 12 may instead be arranged independently of the case of the ECU 5.

The ECU 5 includes a throttle valve opening control unit. The throttle valve opening control unit calculates a control value for a plural of energizing coils in order to rotate a target position in the case of a stepping motor as the electric actuator 7, or a power supply value in the case of a torque generating motor as the electric actuator 7. The control value or the power supply value is calculated according to signals of sensors (a driver's operational status, operational conditions of the engine 1, etc.) inputted into the ECU 5.

The throttle valve opening control unit includes a target valve opening calculation unit to calculate a target valve opening (refer to the solid line in FIG. 1 labeled "target valve opening") of the valve 6. The target valve opening is calculated according to operational conditions, such as accelerator pedal position. The throttle valve opening control unit further includes a compensation unit. The compensation unit carries out a feedback compensation of the control value (or the power supply value) of the electric actuator 7 so that a detected valve opening (refer to the dashed line in FIG. 1 labeled "actual valve opening") of the valve 6 detected by the throttle sensor 8 may be in agreement with the target valve opening.

In addition, various sensors required to control the electric throttle unit 4, such as switches (an ignition switch, a starter switch, etc.) operated by the driver, an accelerator pedal position sensor which detects the accelerator pedal position operated by the driver, a rotational speed sensor which detects rotational speed of the engine 1, and the throttle sensor 8 are connected to the ECU 5.

The electric throttle unit 4 is a type in which the valve 6 stops at the "mechanical full opening B" by mechanical operation for preventive measures for adhering to a wall of a throttle bore if energization of the electric throttle 4 is stopped.

An energization stopping control unit to stop energization of the electric throttle unit 4 is programmed in the ECU 5. The basic operation of the energization stopping control unit is explained.

Figure 2:
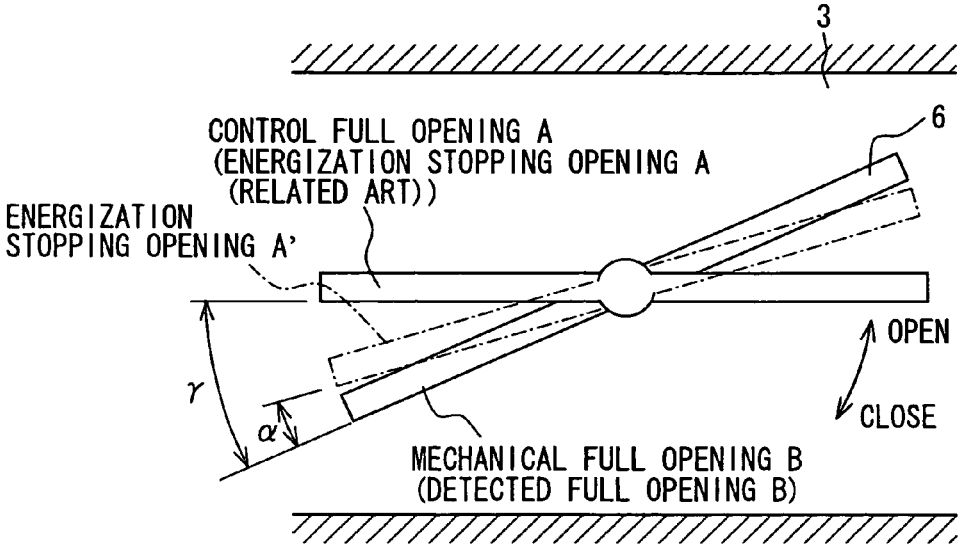
FIG. 2 is an operation diagram of a valve opening of a valve.

As for the energization stopping control unit, if stop directions of the engine 1 are made (the ignition switch is turned off at the timing t3 in FIG. 1), (1) the ECU 5 holds the valve 6 near the fully closed position in order to reduce vibration of the engine 1 produced when the engine 1 is stopped. Next, (2) when a stop of the engine 1 is detected (for example, when an engine rotational speed becomes zero), the valve 6 is moved from the fully closed position to a predetermined opening (an "energization stopping opening A'" as illustrated in FIG. 2 and the dashed and solid lines illustrated at the bottom of FIG. 1) in the direction (counterclockwise direction in FIG. 2) that opens the valve 6 and is maintained at that "energization stopping opening A'". (3) At the timing t4 (see FIG. 1), energization of the electric throttle unit 4 is stopped (as labeled "End of operation" in FIG. 1).

When the operation of the electric throttle unit 4 by the ECU 5 is completed and energization of the electric throttle unit 4 is stopped, the valve 4 rotates an angle (α) from the "energization stopping opening A'" toward the valve opening direction by mechanical operation and stops at the "mechanical full opening B". As can be seen in FIG. 2, the angle (α) indicating the rotation from the "energization stopping opening A'" to the "mechanical full opening B" is smaller than the angle (γ) indicating the rotation from the "energization stopping opening A" to the "mechanical full opening B".

A memory execution unit is programmed in the ECU 5. The memory execution unit is a control program which the memory device memorizes by making into an opening of the valve 6 as a "detected full opening B" detected by the throttle sensor 8 at the time which the valve 6 stops at the "mechanical full opening B" by mechanical operation, when energization of the electric throttle unit 4 is stopped.

That is, as shown in the left-hand side (at the time of engine starting) of FIG. 1, an opening of the valve 6 is detected by the throttle sensor 8 before energization of the electric throttle unit 4 and starting the engine 1 (specifically, from the time at which a turning on of the ignition switch to the time at which a start of energization control of the electric throttle unit 4, that is, time t1–t2 in FIG. 1). The detected opening of the valve 6 (namely, the "mechanical full opening B") is stored as the "detected full opening B" by the memory device (step S1 reference described later).

The energization stopping control unit is also the program which is operated when the engine 1 is stopped. As shown in the right-hand side (at the time of engine stopping) of FIG. 1, the energization stopping control unit stops energization of the electric throttle unit 4 when the valve 4 is rotated at an "energization stopping opening A'". The "energization stopping opening A'" is offset from the "detected full opening B" that stored by the memory device by the angle (α) in a valve-closing direction (Step S3 reference described later). The angle (α) is a predetermined angle is an any angle, for example, between 1 degree and 5 degrees.

In addition, in case the "detected full opening B" cannot be stored to the ECU 5 at the time of starting of the engine 1, the ECU 5 reads the last previously stored "detected full opening B" as a "last recognition value ($B_{-1}$)". The ECU 5 uses a valve opening value which is calculated by subtracting a predetermined safety margin angle (β) from the "last recognition value ($B_{-1}$)" as the "detected full opening B". Thus, the valve opening value ($B_{-1}-\beta$) is offset from the "last recognition value ($B_{-1}$)" by the predetermined safety margin angle (β) in a valve-closing direction (Steps S2 and S4, S5 reference which are described later).

Furthermore, when the "detected full opening B" is not stored at the time of starting of the engine 1 and the "last recognition value ($B_{-1}$)" is also not stored, the ECU 5 uses a "default value" set up beforehand as the "energization stopping opening A'" (Step S4, S6 reference mentioned later).

Figure 3:
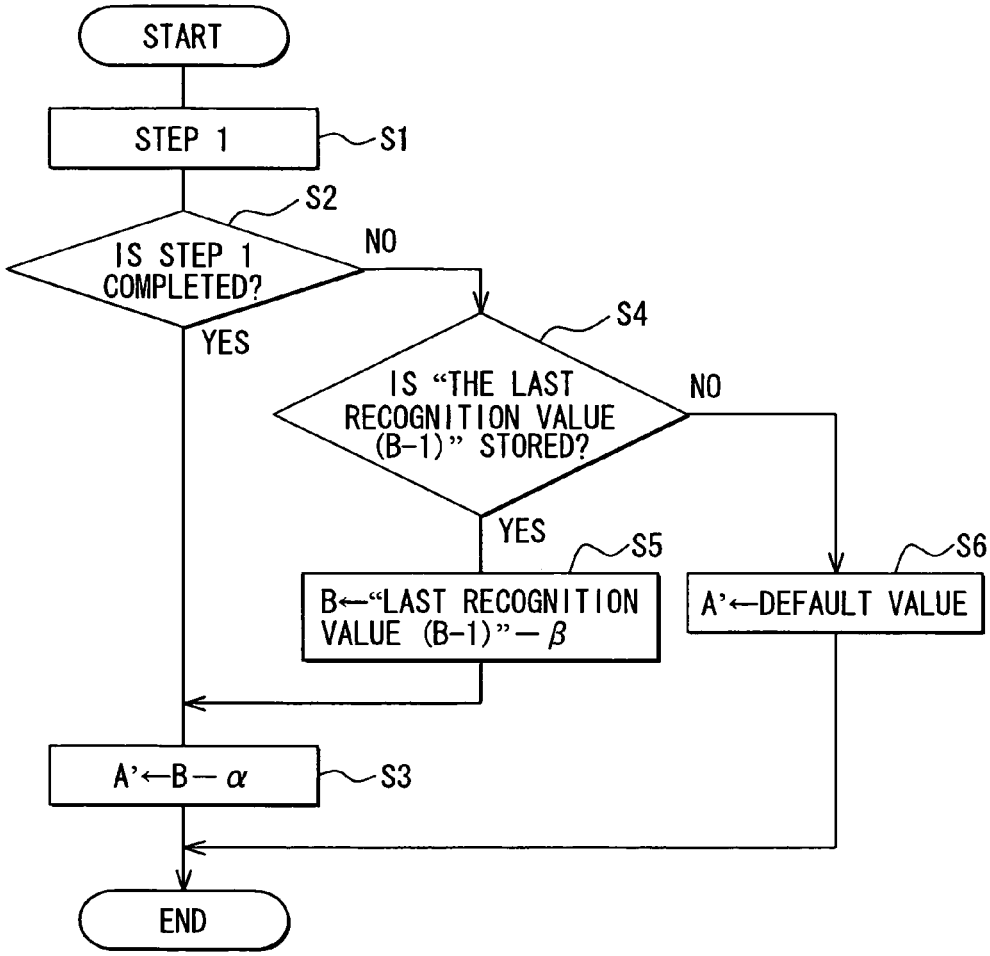
FIG. 3 is a flow chart showing an example of an operation of the throttle control system.
Figure 5:
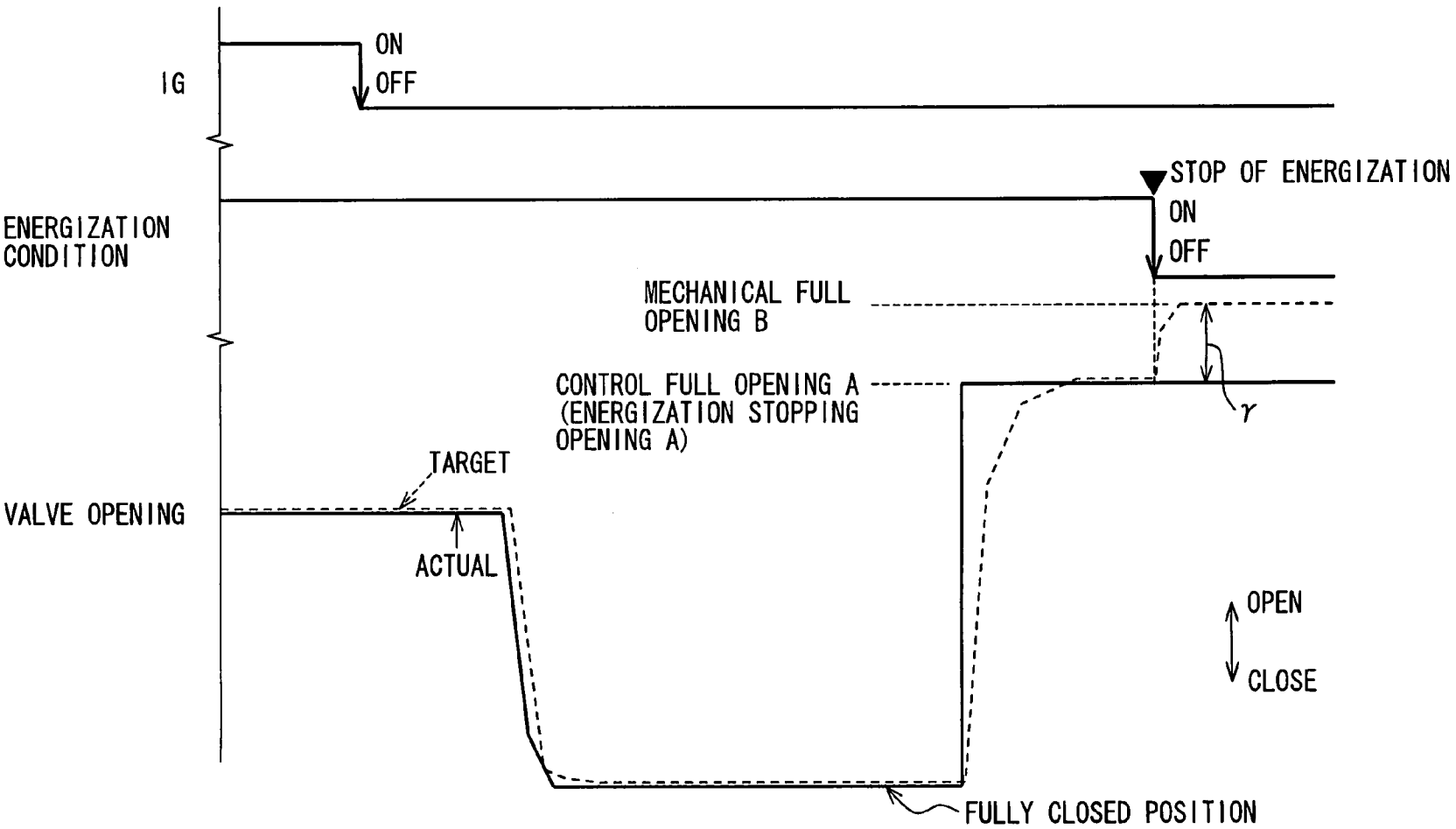
FIG. 5 RELATED ART
FIG. 5 is a time chart showing the operation of related art.

The operation of the memory execution unit and the energization stopping control unit are explained with reference to the flow chart of FIG. 3.

When the operation of the ECU 5 is started, an opening of the valve 6 is detected by the throttle sensor 8 before energization of the electric throttle unit 4 and starting the engine 1, in Step S1 (specifically, from a time at which a turning on of the ignition switch (at the timing t1 in FIG. 1) to a time at which a start of energization control of the electric throttle unit 4 (at the timing t2 in FIG. 1)). Also, the detected opening of the valve 6 (namely, the "mechanical full opening B") is stored as the "detected full opening B" by the memory device, in Step S1.

Next, in Step S2, when an intake drive implementation flag which indicates starting the operation of the electric throttle unit 4 stands at the timing t2 (see FIG. 1), it is determined whether the operations of step S1 is completed. That is, when the intake drive implementation flag stands, it is determined whether the "mechanical full opening B" has been stored as the "detected full opening B."

When energization of the electric throttle unit 4 is stopped at the timing t4 (see FIG. 1), if the determination of Step S2 is YES, in Step S3, energization of the electric throttle 4 is ended after moving the valve 6 to the "energization stopping opening A'" which is offset from the "detected full opening B" stored at Step S1 by the predetermined angle (α) in a valve-closing direction.

When energization of the electric throttle unit 4 is stopped, if the determination of Step S2 is NO, in Step S4, it is determined whether the "last recognition value ($B_{-1}$)" is stored.

If the determination of step S4 is YES, a valve opening value is calculated by subtracting the predetermined safety margin angle (β) from the "last recognition value ($B_{-1}$)" as the "detected full opening B". Thus, the "detected full opening B" (namely, the valve opening value ($B_{-1}-\beta$)) is offset from the "last recognition value ($B_{-1}$)" by the predetermined safety margin angle (β) in a valve-closing direction). The predetermined safety margin angle (β) is larger than the predetermined angle (α).

When the determination of Step S4 is NO, the "default value" set up beforehand is used as the "energization stopping opening A'."

The throttle control system of first example embodiment makes the memory device store an opening of valve 6 during starting the engine 1 before energization of the electric throttle unit 4 (that is, a time period which the valve 6 keep stopping at the "mechanical full opening B" (during the timings t1 and t2 in FIG. 1)) as the "detected full opening B".

Thus, it becomes possible to coincide the "actual valve opening" of the valve 6 and a control valve opening which the ECU 5 recognizes, and a system variation between the electric throttle unit 4 and the ECU 5 can be reduced.

Energization of the electric throttle unit 4 is stopped after the valve 6 moves to the "energization stopping opening A'" which is offset from the "detected full opening B" stored by the memory device by the predetermined angle alpha (α) in a valve-closing direction. Thus, even if mechanical variation is produced in the electric throttle unit 4, a rotational difference of the valve opening positions between the "actual valve opening" of the valve 6 at the "energization stopping opening A'" and the "mechanical full opening B" after energization of the electric throttle unit 4 is stopped is always made to a regular occurring amount (that is, the predetermined angle (α)).

As a result, the rotational difference of the valve opening positions between the "energization stopping opening A'" and the "mechanical full opening B" can be made small and collision sound at the time energization of the electric throttle unit 4 is stopped becomes smaller.

Moreover, in the first example embodiment, since the "mechanical full opening B" is stored as the "detected full opening B" for every starting of the engine 1, an accuracy of angle control of the valve 6 can be improved. This enables the difference of the angles of the "energization stopping opening A'" and the "mechanical full opening B" (namely, the predetermined angle (α) which is the amount of offset) to be made very small. Therefore, the collision sound at the time of stopping energization of the electric throttle unit 4 can become much smaller.

Modification and other example embodiments will be now described.

The first example embodiment shows an example which stores the "mechanical full opening B" as the "detected full opening B" for every starting of the engine 1. On the other hand, the "mechanical full opening B" may be stored immediately after stopping energization of the electric throttle unit 4 as the "detected full opening B."

A valve opening (the mechanical full opening B) of the valve 6 may be stored at the time when energization of the electric throttle 4 is stopped only if the "detected full opening B" is not stored by the memory device, such as the time of shipment of vehicles, as the "detected full opening B."

The present invention should not be limited to the disclosed example embodiments, but may be implemented in other ways without departing from the spirit of the aspect.

What is claimed is:

1. A throttle control system comprising:

a valve for opening and closing an air intake passage;

an electric throttle unit for electrically driving the valve, and to stop the valve at a mechanical full opening by a mechanical operation when energization of the electric throttle unit is stopped;

an control unit for controlling energization of the electric throttle unit;

a throttle sensor for detecting an opening of the valve;

a memory device for storing data corresponding to an opening signal of the throttle sensor; and a memory execution unit for enabling the memory device to store data corresponding to the opening signal detected by the throttle sensor as a detected full opening of the valve, when energization of the electric throttle unit is stopped and the valve is stopped at the mechanical full opening by mechanical operation;

wherein the memory execution unit enables the memory device to store data corresponding to an opening signal detected by the throttle sensor as the detected full opening of the valve, before beginning energization of the electric throttle unit.

2. A throttle control system comprising:

a valve for opening and closing an air intake passage;

an electric throttle unit for electrically driving the valve, and to stop the valve at a mechanical full opening by a mechanical operation when energization of the electric throttle unit is stopped;

an control unit for controlling energization of the electric throttle unit;

a throttle sensor for detecting an opening of the valve;

a memory device for storing data corresponding to an opening signal of the throttle sensor; and a memory execution unit for enabling the memory device to store data corresponding to the opening signal detected by the throttle sensor as a detected full opening of the valve, when energization of the electric throttle unit is stopped and the valve is stopped at the mechanical full opening by mechanical operation;

wherein the valve stops at the mechanical full opening by abutting a moving portion of the electric throttle unit on a full open stopper provided with a fixed portion, when energization of the electric throttle unit is stopped.

3. A throttle control system comprising:

a valve for opening and closing an air intake passage;

an electric throttle unit for electrically driving the valve, and to stop the valve at a mechanical full opening by a mechanical operation when energization of the electric throttle unit is stopped;

an control unit for controlling energization of the electric throttle unit;

a throttle sensor for detecting an opening of the valve;

a memory device for storing data corresponding to an opening signal of the throttle sensor;

a memory execution unit for enabling the memory device to store data corresponding to the opening signal detected by the throttle sensor as a detected full opening of the valve, when energization of the electric throttle unit is stopped and the valve is stopped at the mechanical full opening by mechanical operation; and an energization stopping control unit for stopping energization of the electric throttle unit at an energization stopping opening which is offset from the detected full opening stored by the memory device by a predetermined angle in a valve-closing direction.

4. The throttle control system according to claim 3, wherein the predetermined angle is less than an angle between the detected full opening and an opening at which the valve opening forms a 100% aperture ratio of the air intake passage.

5. A method of controlling an electric throttle control unit, the method comprising:

receiving a signal for turning on an ignition switch;

receiving a signal for energizing the electric throttle control unit;

detecting a position of a valve of the electric throttle control unit after receiving the signal for turning on the ignition switch;

storing data corresponding to the detected position of the valve as a full opening valve position in a memory device;

receiving a signal for stopping the energizing of the electric throttle control unit; and controlling the valve so that the valve is moved to and stopped at the full opening valve position after receiving the signal for stopping the energizing of the electric throttle control unit.

6. The method as in claim 5, wherein the position of the valve is detected before the signal for energizing the electric throttle control unit is received.

7. The method as in claim 5, controlling the valve so that the valve is moved to and stopped at a predetermined position after receiving a signal for turning off the ignition switch but before receiving the signal for stopping the energizing of the electric throttle control unit.

8. The method as in claim 7, wherein a rotational angle between the full opening valve position and the predetermined position is less than a rotational angle between the full opening valve position and a position of the valve which forms a 100% aperture ratio within a passage in which the valve is located.

9. The method as in claim 8, wherein the valve is moved from the predetermined position to the full opening valve position when the signal for stopping the energizing of the electric throttle control unit is received.

* * * * *